US012595654B1

(12) United States Patent
Patton

(10) Patent No.: US 12,595,654 B1
(45) Date of Patent: Apr. 7, 2026

(54) REINFORCED INSULATION PANEL SYSTEM

(71) Applicant: Lucas E. Patton, Fort Ripley, MN (US)

(72) Inventor: Lucas E. Patton, Fort Ripley, MN (US)

( * ) Notice: Subject to any disclaimer, the term of this patent is extended or adjusted under 35 U.S.C. 154(b) by 366 days.

(21) Appl. No.: 18/330,335

(22) Filed: Jun. 6, 2023

(51) Int. Cl.
*E04B 1/76* (2006.01)
*E04B 1/80* (2006.01)

(52) U.S. Cl.
CPC ..... *E04B 1/7654* (2013.01); *E04B 1/80* (2013.01)

(58) Field of Classification Search
CPC ..... E04B 1/7654; E04B 1/80
See application file for complete search history.

(56) References Cited

U.S. PATENT DOCUMENTS 6,644,535 B2 * 11/2003 Wallach ..... B23K 11/008 228/178
6,796,093 B2 * 9/2004 Brandes ..... E04C 2/205 52/309.8
6,941,720 B2 * 9/2005 DeFord ..... E04C 2/043 52/783.17
7,563,497 B2 * 7/2009 Ma ..... E04C 2/34 442/205
8,464,483 B2 6/2013 Holt
8,539,733 B2 * 9/2013 Bogeskov ..... E04B 7/225 52/404.4
8,863,463 B2 * 10/2014 Bogeskov ..... E04B 2/7457 52/475.1
8,925,270 B2 * 1/2015 Grisolia ..... E04C 2/386 52/309.7
9,151,053 B2 * 10/2015 Stephens, Jr. ..... E04B 1/7608
9,469,984 B2 * 10/2016 Miks ..... E04F 13/007
9,909,305 B2 * 3/2018 Lee ..... E04B 1/7675
9,920,528 B1 * 3/2018 Biesiadecki ..... B32B 3/08
10,167,630 B2 * 1/2019 Giles ..... E04B 1/80
10,179,428 B2 * 1/2019 Roper ..... B29C 44/1214
10,323,413 B1 * 6/2019 Biesiadecki ..... E04C 2/06
10,364,571 B1 * 7/2019 Moghaddam ..... E04B 1/02
10,370,849 B2 * 8/2019 Lambach ..... E04B 1/10
10,415,244 B2 * 9/2019 Giles ..... E04C 2/292
10,480,188 B2 11/2019 Power
11,098,479 B2 8/2021 Amend
11,214,958 B1 * 1/2022 Lambach ..... E04C 2/205
11,225,790 B1 * 1/2022 Lambach ..... B32B 15/18
11,905,707 B2 * 2/2024 Giles ..... C08J 9/148
2002/0043045 A1 * 4/2002 Marino Del Din ..... E04B 2/847 52/783.1
2002/0139082 A1 * 10/2002 DeFord ..... C04B 28/02 52/794.1
2002/0170941 A1 * 11/2002 Wallach ..... B21F 27/128 228/173.1
2003/0172607 A1 * 9/2003 Brandes ..... E04C 2/384 52/407.3

(Continued)

*Primary Examiner* — Rodney Mintz
(74) *Attorney, Agent, or Firm* — Fargo Patent & Business Law; Thomas Kading

(57) ABSTRACT

An insulation panel includes a rectilinear panel manufactured of a foam and a multiple of non-metallic I-beams at least partially embedded within the rectilinear panel in a parallel arrangement, each of the multiple of non-metallic I-beams includes an engagement member along a web engaged with the foam.

21 Claims, 6 Drawing Sheets

(56) References Cited

U.S. PATENT DOCUMENTS

2005/0284088 A1* 12/2005 Heath ..... E04B 2/845 52/741.1
2006/0141232 A1* 6/2006 Ma ..... E04C 2/34 428/292.1
2007/0227086 A1* 10/2007 Beavers ..... E04B 1/80 52/309.7
2008/0155919 A1* 7/2008 Keshishian ..... E04C 2/044 52/690
2008/0184663 A1* 8/2008 Martirossyan ..... E04C 2/044 52/745.19
2009/0056256 A1* 3/2009 Blomquist, Jr. ..... E04B 2/845 52/309.8
2010/0307090 A1* 12/2010 Hatamian ..... E04C 2/324 52/309.4
2011/0107721 A1* 5/2011 Bogeskov ..... E04B 1/26 52/762
2011/0113724 A1* 5/2011 Bogeskov ..... E04D 13/1625 52/762
2011/0296785 A1* 12/2011 Holt ..... E04C 2/205 52/783.1
2014/0033627 A1* 2/2014 Stephens, Jr. ..... E04C 2/205 52/204.5
2014/0053486 A1* 2/2014 Grisolia ..... E04B 2/00 52/309.7
2014/0345223 A1* 11/2014 Miks ..... E04B 2/562 52/309.4
2015/0093535 A1* 4/2015 Lambach ..... B29C 44/12 52/745.1
2015/0135623 A1* 5/2015 Garrett ..... E04C 2/38 52/745.1
2017/0362823 A1* 12/2017 Lee ..... E04C 3/32
2018/0112394 A1* 4/2018 Giles ..... E04B 1/7629
2018/0133936 A1* 5/2018 Roper ..... F02K 9/605
2018/0258633 A1* 9/2018 Power ..... E04C 2/322
2018/0363298 A1* 12/2018 Giles ..... B29C 44/3403
2021/0040727 A1* 2/2021 Amend ..... E04B 1/7612
2022/0412081 A1* 12/2022 Giles ..... C08G 18/72

* cited by examiner

REINFORCED INSULATION PANEL SYSTEM

CROSS REFERENCE TO RELATED APPLICATION[S]

None

BACKGROUND

The present disclosure relates to building construction, and more specifically to insulation therefor.

Exterior walls are often constructed using framing techniques, whereby structural members such as lumber studs are used to form frames to which sheathing and insulation are applied. Other wall construction methods, such as concrete wall construction or metal stud construction, may alternatively be used. Interior walls of a building may be finished with drywall or plaster, appropriately treated, and painted or wallpapered.

The exterior walls of the building can also be finished in various ways, but with most techniques it is common to first apply a thin weather barrier of plastic, foil, or other material having low water permeability against the exterior of the wall, the outer layer of which may be of plywood, pressboard, chipboard, oriented strand board (OSB), or other materials. Such a weather barrier impedes the ingress of moisture. With frame construction, fiberglass insulation is typically inserted between the studs against the exterior sheathing to insulate the walls and thereby retain desirably heated or cooled air.

SUMMARY

An insulation panel according to one disclosed non-limiting embodiment of the present disclosure includes a rectilinear panel manufactured of a foam; a multiple of non-metallic I-beams at least partially embedded within the foam of the rectilinear panel in a parallel arrangement, each of the multiple of non-metallic I-beams including a web between a first flange and a second flange; and an engagement member along the web engaged with the foam of the rectilinear panel.

A further embodiment of any of the foregoing embodiments of the present disclosure includes that the engagement member comprises a zig-zag shape that extends from the web.

A further embodiment of any of the foregoing embodiments of the present disclosure includes a multiple of apertures that extend through the web and the first flange.

A further embodiment of any of the foregoing embodiments of the present disclosure includes that the multiple of apertures are spaced at 8 inches, 24 inches, 40 inches, 56 inches, 72 inches, and 88 inches of a 96 inch tall insulation panel.

A further embodiment of any of the foregoing embodiments of the present disclosure includes that the first flange is exposed, and the second flange is embedded within the foam.

A further embodiment of any of the foregoing embodiments of the present disclosure includes a multiple of apertures that extend through the web and the first flange.

A further embodiment of any of the foregoing embodiments of the present disclosure includes that the multiple of apertures are spaced at 8 inches, 24 inches, 40 inches, 56 inches, 72 inches, and 88 inches of a 96 inch tall insulation panel.

A further embodiment of any of the foregoing embodiments of the present disclosure includes that the engagement member comprises a zig-zag shape that extends from the web.

A further embodiment of any of the foregoing embodiments of the present disclosure includes that the multiple of non-metallic I-beams extend along a long axis of the rectilinear panel.

A further embodiment of any of the foregoing embodiments of the present disclosure includes that the multiple of non-metallic I-beams comprise three (3) non-metallic I-beams at 8 inches, 24 inches, and 40 inches, within a 48 inch×96 inch×2 inch insulation panel.

A further embodiment of any of the foregoing embodiments of the present disclosure includes a multiple of apertures that extend through the web and the first flange.

A further embodiment of any of the foregoing embodiments of the present disclosure includes that the multiple of apertures are spaced at 8 inches, 24 inches, 40 inches, 56 inches, 72 inches, and 88 inches of a 96 inch tall insulation panel.

A further embodiment of any of the foregoing embodiments of the present disclosure includes that at least one of the multiple of non-metallic I-beams comprises a closed edge parallel to a web thereof.

An insulation panel according to one disclosed non-limiting embodiment of the present disclosure includes a first rectilinear panel portion manufactured of a foam; a second rectilinear panel portion manufactured of the foam, the second rectilinear panel portion perpendicular to the first rectilinear panel portion; a first non-metallic I-beam at least partially embedded within the first rectilinear panel portion, the first non-metallic I-beam comprises a first web; a first engagement member along the first web engaged with the first rectilinear panel portion; a second non-metallic I-beam at least partially embedded within the second rectilinear panel portion, the second non-metallic I-beam comprises a second web; and a second engagement member along the second web engaged with the second rectilinear panel portion.

A further embodiment of any of the foregoing embodiments of the present disclosure includes that the first and second engagement member comprises a zig-zag shape that extends from the web.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
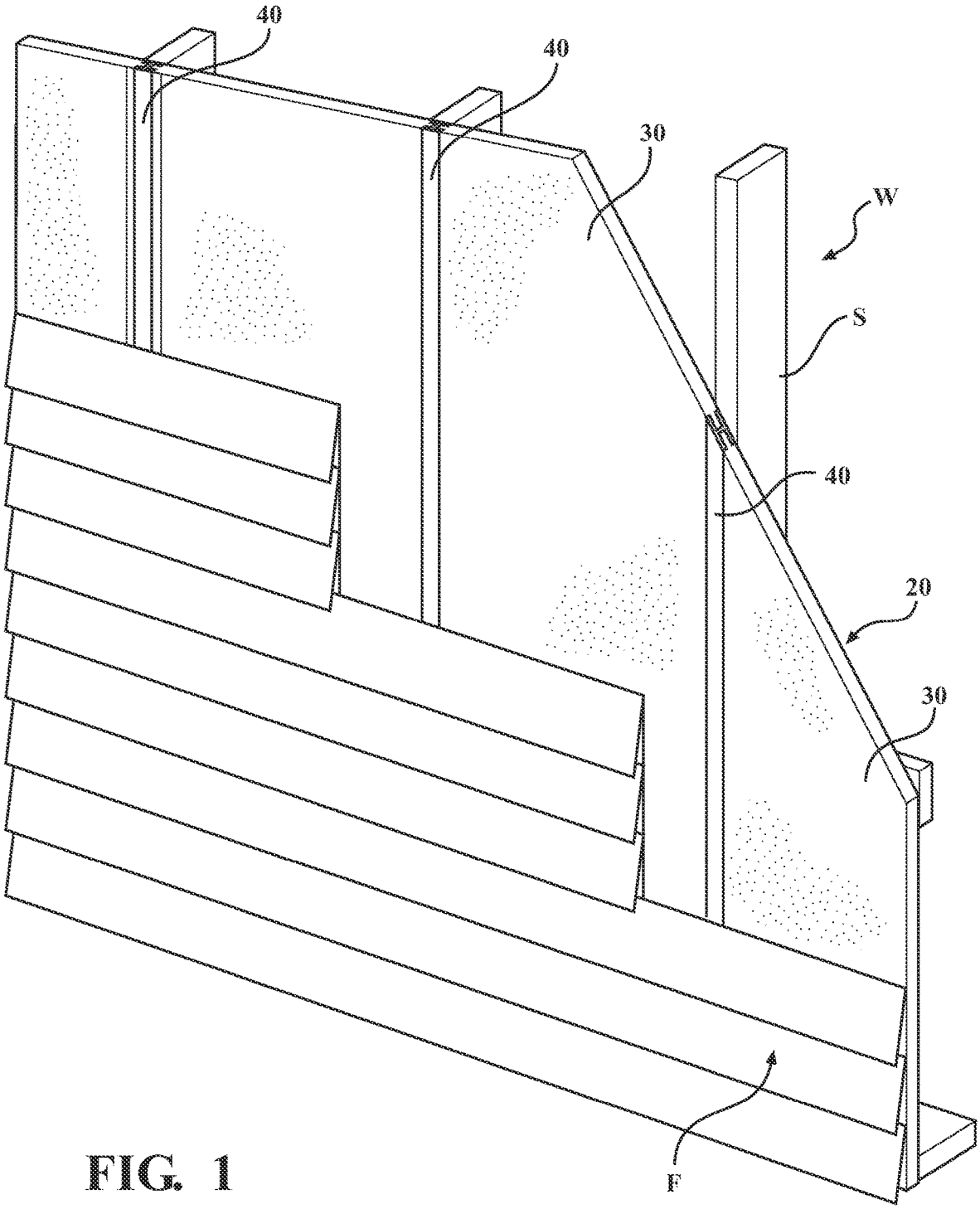
FIG. 1 is an exploded view of a wall of a building, with an insulation panel according to one disclosed non-limiting embodiment.

FIG. 1 schematically illustrates an insulation panel 20 that is readily fastened to a wall W of a building, and provides an insulated fastening surface for the installation of finishing materials F such as siding panels on the building exterior. The wall W may be fabricated by frame construction, for example, a stud frame S. Other wall components such as a plywood or oriented strand board sheathing, and a vapor barrier may alternatively or additionally utilized to manufacture the wall W. It should be appreciated that various wall constructions may alternatively or additionally be provided.

Figure 2:
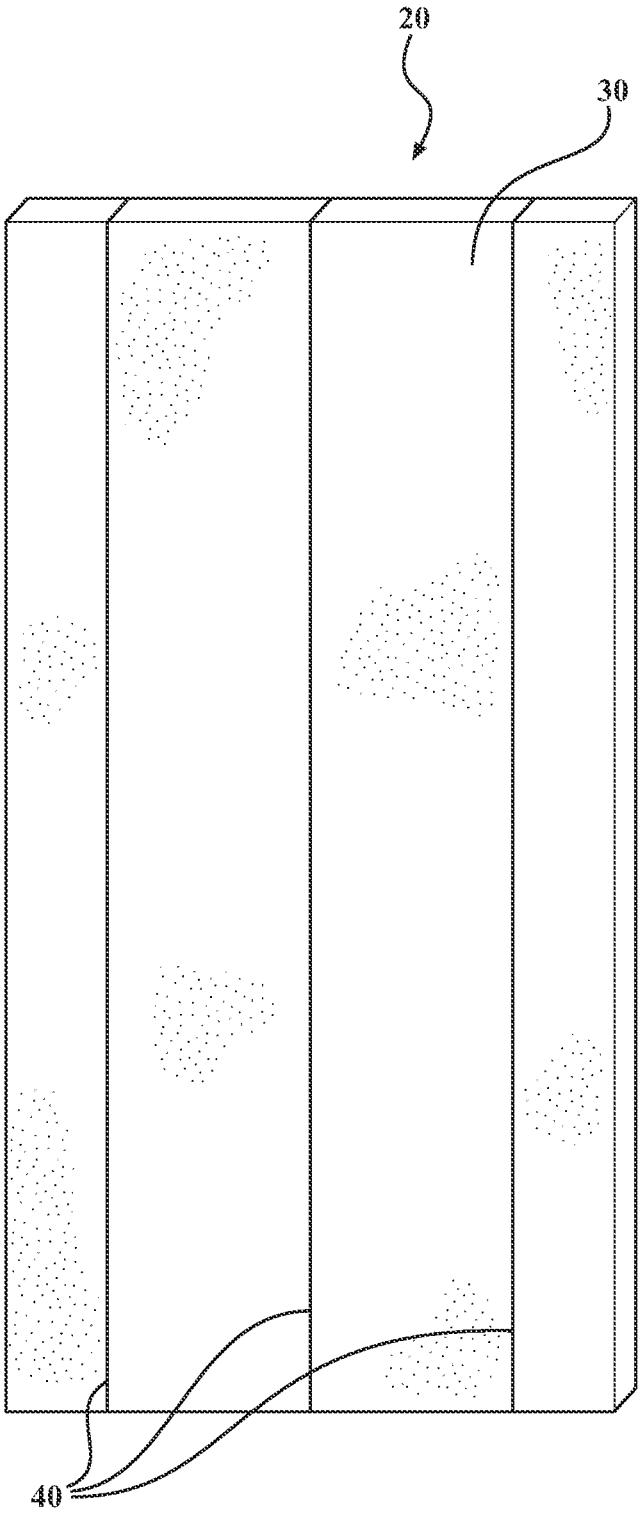
FIG. 2 is a front view of the insulation panel.

With reference to FIG. 2, the insulation panel 20 generally includes a foam 30 manufactured as panel and a multiple of non-metallic I-beams 40 (also shown in 3A-3C) at least partially embedded within the foam 30. In one embodiment, the foam 30 may be manufactured of extruded polystyrene and the non-metallic I-beams 40 may be manufactured of a plastic such as, for example, Polyethylene Terephthalate (PET or PETE), High-Density Polyethylene (HDPE), Polyvinyl Chloride (PVC or Vinyl), Low-Density Polyethylene (LDPE), Polypropylene (PP), Polystyrene (PS or Styrofoam), etc.

In one embodiment, the insulation panel 20 may be a rectilinear panel that is 48 inches wide, 96 inches tall, and 2 inches thick. Each of the multiple of non-metallic I-beams 40 within the insulation panel 20 may be parallel and spaced at 8 inches, 24 inches, and 40 inches of a 48-inch-wide insulation panel 20. That is, the multiple of non-metallic I-beams 40 are parallel and spaced to readily align with the underlaying stud frames S.

Figure 3A:
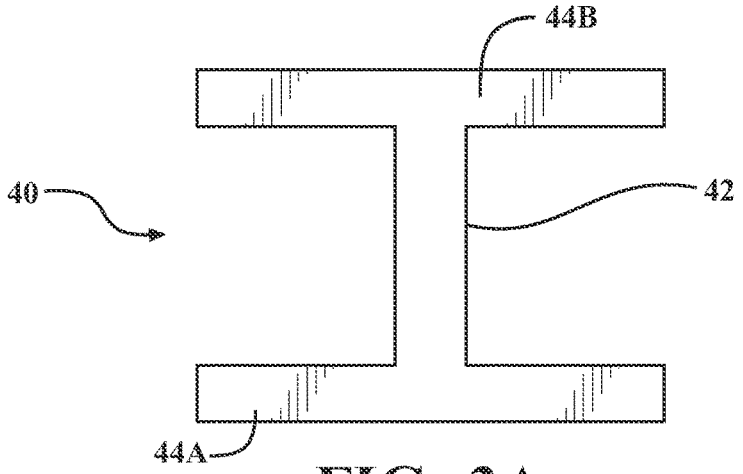
FIG. 3A is a top view of a non-metallic I-beams for the insulation panel.
Figure 3C:
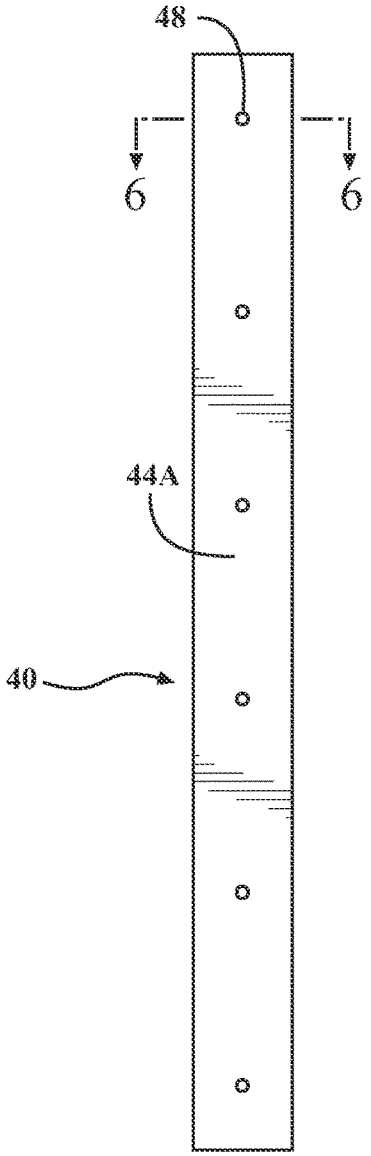
FIG. 3C is a front view of a non-metallic I-beam for the insulation panel showing a multiple of apertures that extend through a first flange, a web, and a second flange.
Figure 3B:
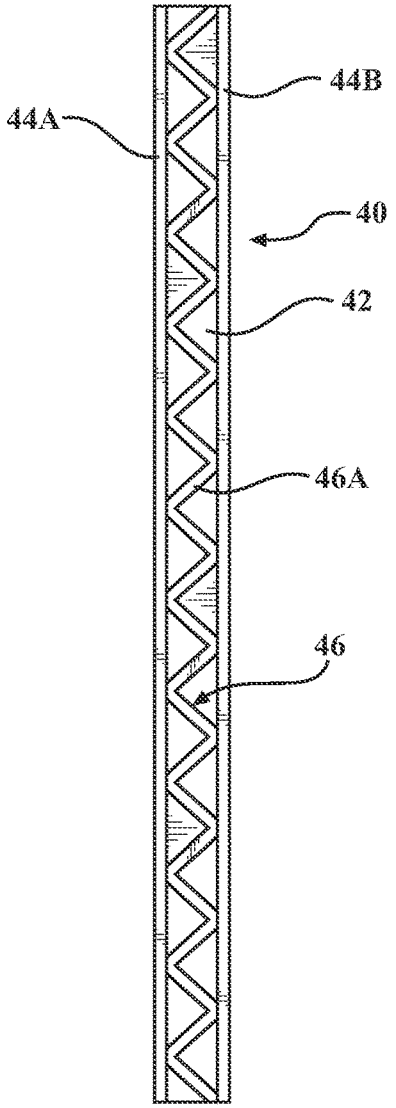
FIG. 3B is a side view of the non-metallic I-beams for the insulation panel showing an engagement member along the web thereof.
Figure 4:
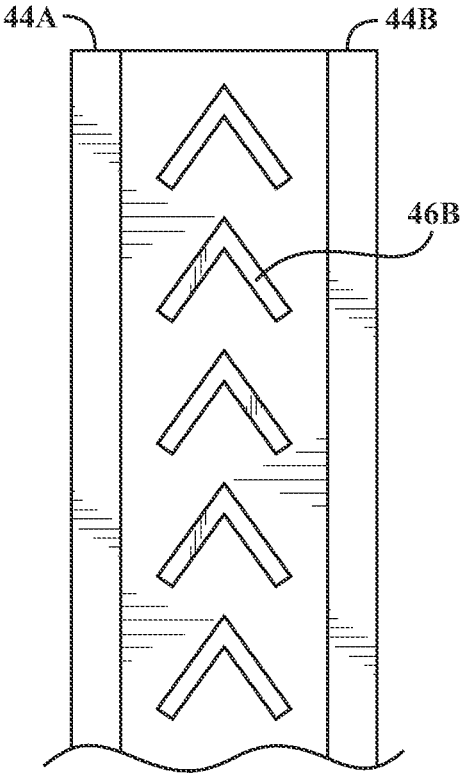
FIG. 4 is a side view of a non-metallic I-beam for the insulation panel showing an engagement member along the web thereof according to another disclosed non-limiting embodiment.
Figure 5:
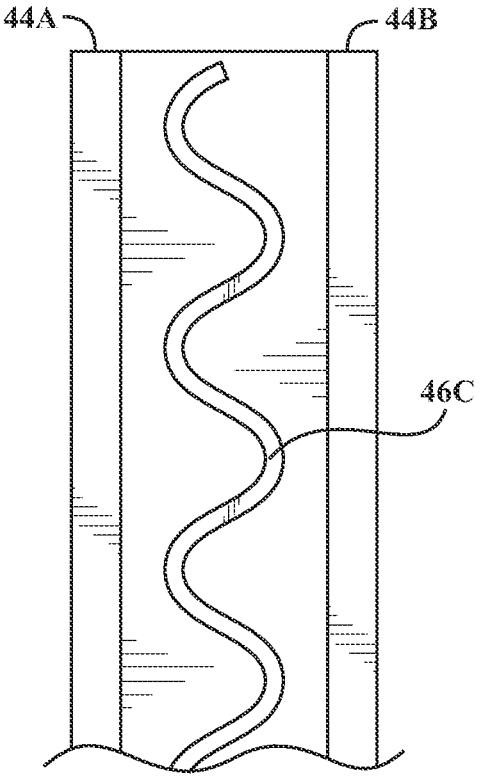
FIG. 5 is a side view of a non-metallic I-beam for the insulation panel showing an engagement member along the web thereof according to another disclosed non-limiting embodiment.

With reference to FIG. 3A-3C, each of the multiple of non-metallic I-beams 40 may include a web 42 between a first flange 44A and a second flange 44B. An engagement member 46 is formed along the web 42 to facilitate engagement with the foam 30. That is, the engagement member 46 extends from the web 42 between the first flange 44A and the second flange 44B. The engagement member 46 may be a zig-zag shape 46*a* (FIG. 3B), a chevron shape 46*b* (FIG. 4), a serpentine shape 46*c* (FIG. 5), or other such shape that extends from the web 42 to facilitate engagement or "bite" into the foam 30 during manufacture.

Figure 6:
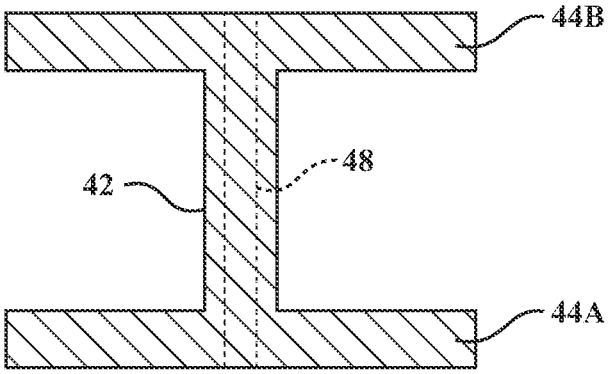
FIG. 6 is a sectional view of the non-metallic I-beam taken along line 6-6 in FIG. 3C illustrating one of the multiple of apertures that extend through a first flange, a web, and a second flange.

Each of the multiple of non-metallic I-beams 40 includes a multiple of apertures 48 that extend through the first flange 44A, the web 42, and the second flange 44B. That is, each of the multiple of apertures 48 extend parallel through the web 42 and transversely though the first flange 44A and the second flange 44B (FIG. 6) to receive nails or screws to mount the insulation panel 20 to the stud frames S. In one embodiment, the multiple of apertures 48 are spaced at 8 inches, 24 inches, 40 inches, 56 inches, 72 inches, and 88 inches of a 96 inch tall insulation panel 20. In another embodiment, the web 42 proximate the apertures 48 (e.g., at 8 inches, 24 inches, 40 inches, 56 inches, 72 inches, and 88 inches) may be locally reinforced, i.e., have a thickened web area to facilitate support of nails or screws to mount the insulation panel 20 to the stud frames S.

Figure 7:
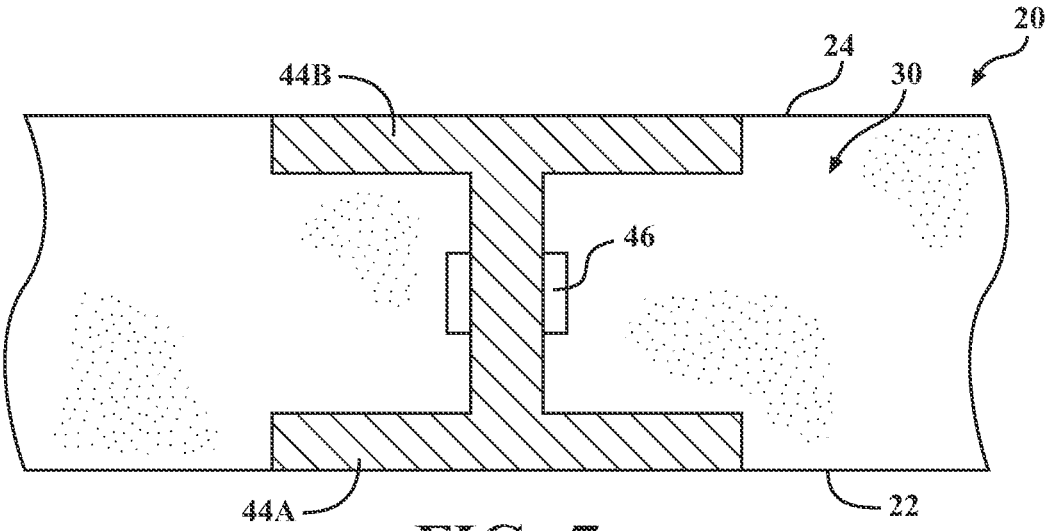
FIG. 7 is a sectional view of the insulation panel according to another disclosed non-limiting embodiment showing one non-metallic I-beam that extends the width of the foam.

With reference to FIG. 7, in one embodiment, the multiple of non-metallic I-beams 40 may be at least partially embedded in the foam 30. That is, a face of the first flange 44A and a face of the second flange 44B are respectively parallel to a front face 22 and a back face 24 of the insulation panel 20 and are thus visible. In this embodiment, the multiple of non-metallic I-beams 40 may be 2 inches wide from face to face of the first flange 44A and the second flange 44B. it should be appreciated that "visible" as utilized herein does not preclude a thin layer of the foam 30 which may overlay the face of the first flange 44A, however, the foam 30 is thin enough that the face of the first flange 44A is visible and the apertures 48 may appear as indentations or divots.

Figure 8:
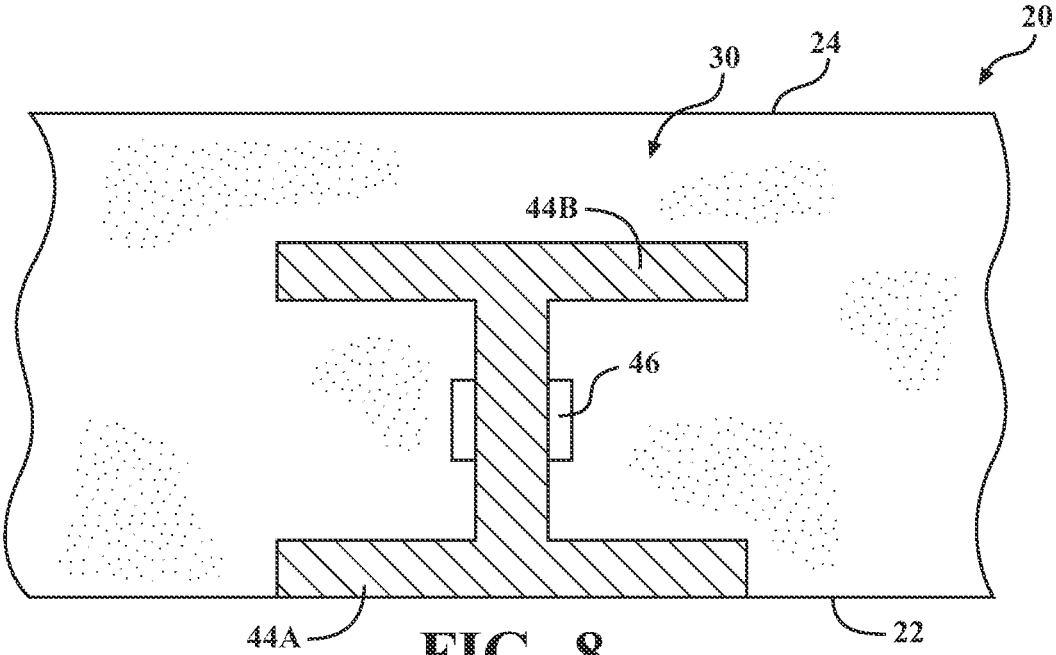
FIG. 8 is a sectional view of the insulation panel according to another disclosed non-limiting embodiment showing one non-metallic I-beam that is partially embedded within the width of the foam.

With reference to FIG. 8, in another embodiment, the second flange 44B is completely embedded in the foam 30. That is, only the face of the first flange 44A is visible in the front face 22.

Figure 9:
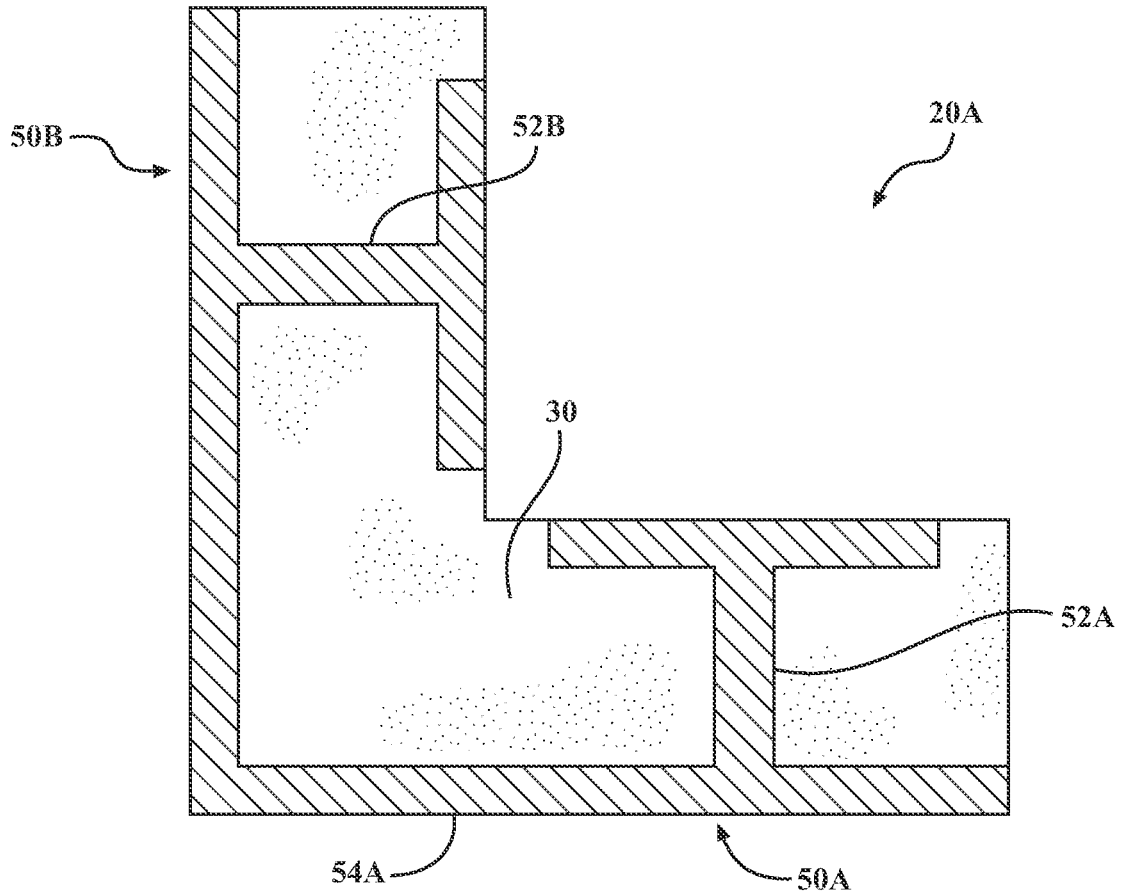
FIG. 9 is a perspective view of an insulation panel geometrically configured as a corner piece according to another disclosed non-limiting embodiment.

With reference to FIG. 9, an insulation panel 20A, according to another embodiment, may be geometrically configured for a particular application. In this embodiment, the insulation panel 20A may be configured as a corner with perpendicular panel portions 50A, 50B, each of which includes a non-metallic I-beam 40 having a web 52A, 52B. An extended length first flange 54A may be integral with each web 52A, 52B along an outside corner. That is, the extended length first flange 54A forms an outer corner of the insulation panel 20A. the insulation panel 20A may be particularly appropriate for window corners, door, etc.

Figure 10:
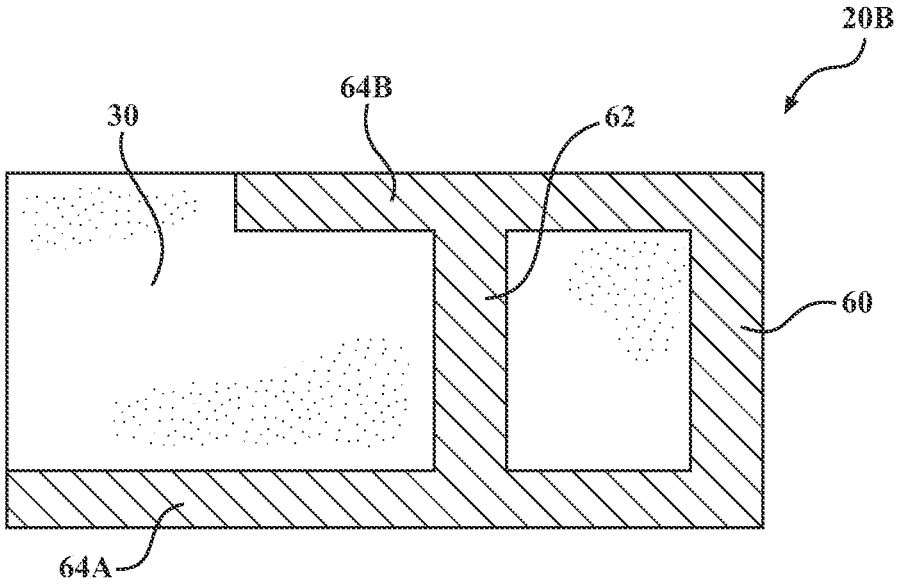
FIG. 10 is a perspective view of an insulation panel geometrically configured as an end piece according to another disclosed non-limiting embodiment.

With reference to FIG. 10, an insulation panel 20B, according to another embodiment, may be geometrically configured as an end piece. In this embodiment, the insulation panel 20B may include a non-metallic I-beam 40 with a closed edge 60 parallel to a web 62 and an extended length first flange 64A with respect to a second flange 64B.

It should be appreciated that the insulation panel may be configured in various geometric arrangements for particular usages such as window corners, doors, etc.

The insulation panel reduces install time to provide insulation to the exterior of a new or existing home without additionally requiring the installation of wood nailing strips for siding. The insulation panel may be sized to maintain current sized extension jambs from doors and windows at a standard width.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. An insulation panel, comprising:

a rectilinear panel composed of foam;

a multiple of non-metallic I-shaped beams at least partially embedded within the foam of the rectilinear panel in a parallel arrangement, each of the multiple of non-metallic I-shaped beams comprising a web extending continuously between a first flange and a second flange; and an engagement member attached to the web and extending transverse from the web between the first flange and the second flange, the engagement member engaged with the foam of the rectilinear panel to penetrate into the foam during manufacture, wherein at least a portion of the first flange is exposed and substantially parallel to an outer surface of the foam.

2. The insulation panel as recited in claim 1, wherein the engagement member comprises a zig-zag shape that extends from each side of the web.

3. The insulation panel as recited in claim 1, wherein at least one of the multiple of non-metallic I-shaped beams comprises a closed edge parallel to a respective said web thereof.

4. The insulation panel as recited in claim 1, wherein at least the portion of the first flange and at least a portion of the second flange are exposed and substantially parallel to the outer surface of the foam.

5. The insulation panel as recited in claim 1, further comprising a multiple of apertures that extend through the web and the first flange, wherein each of the multiple of apertures are parallel to the web and transverse to the first flange such that an end of each of the multiple of apertures are exposed in the first flange which is exposed and substantially parallel to the outer surface of the foam.

6. The insulation panel as recited in claim 1, further comprising a multiple of apertures that extend longitudinally through the web and the first flange.

7. The insulation panel as recited in claim 6, wherein the multiple of apertures are spaced at 8 inches, 24 inches, and 40 inches, 56 inches, 72 inches, and 88 inches of a 96 inch tall insulation panel.

8. The insulation panel as recited in claim 1, wherein the multiple of non-metallic I-beams extend along a long axis of the rectilinear panel.

9. The insulation panel as recited in claim 8, wherein the multiple of non-metallic I-beams comprise three (3) non-metallic I-beams at 8 inches, 24 inches, and 40 inches, within a 48 inch×96 inch×2 inch insulation panel.

10. The insulation panel as recited in claim 9, further comprising a multiple of apertures that extend through the web and the first flange.

11. The insulation panel as recited in claim 10, wherein the multiple of apertures are spaced at 8 inches, 24 inches, and 40 inches, 56 inches, 72 inches, and 88 inches of a 96 inch tall insulation panel.

12. The insulation panel as recited in claim 1, wherein the first flange is exposed and the second flange is embedded within the foam.

13. The insulation panel as recited in claim 12, further comprising a multiple of apertures that extend through the web and the first flange.

14. The insulation panel as recited in claim 13, wherein the multiple of apertures are spaced at 8 inches, 24 inches, and 40 inches, 56 inches, 72 inches, and 88 inches of a 96 inch tall insulation panel.

15. The insulation panel as recited in claim 14, wherein the engagement member comprises a zig-zag shape that extends from the web.

16. The insulation panel as recited in claim 14, wherein each of the multiple of apertures are parallel to the web and transverse to the first flange such that an end of each of the multiple of apertures are exposed.

17. The insulation panel as recited in claim 14, wherein each of the multiple of apertures extend through the web, the first flange and the second flange, each of the multiple of apertures are parallel to the web and transverse to the first flange and the second flange such that an end of each of the multiple of apertures are exposed.

18. An insulation panel, comprising:

a first rectilinear panel portion composed of foam;

a second rectilinear panel portion composed of foam, the second rectilinear panel portion perpendicular to the first rectilinear panel portion;

a first non-metallic I-shaped beam at least partially embedded within the first rectilinear panel portion, the first non-metallic I-shaped beam comprises a first web extending continuously between a first flange and a second flange;

a first engagement member attached to the first web and extending transverse from the first web between the first flange and the second flange of the first non-metallic I-shaped beam, the first engagement member engaged with the first rectilinear panel portion to penetrate into the foam during manufacture;

a second non-metallic I-shaped beam at least partially embedded within the second rectilinear panel portion, the second non-metallic I-shaped beam comprises a second web extending continuously between a first flange and a second flange; and a second engagement member attached to the second web and extending transverse from the second web between the first flange and the second flange of the second non-metallic I-shaped beam, the second engagement member engaged with the foam of the second rectilinear panel portion to penetrate into the foam during manufacture, wherein at least a portion of one of the first flanges or at least a portion of one of the second flanges is exposed and substantially parallel to an outer surface of a respective said foam.

19. The insulation panel as recited in claim 18, wherein the first and second engagement member comprises a zig-zag shape that extends from the web.

20. The insulation panel as recited in claim 18, wherein at least the portion of the first flange and at least the portion of the second flange of the first non-metallic I-shaped beam is exposed and substantially parallel to the outer surface of the foam thereof.

21. The insulation panel as recited in claim 18, wherein at least the portion of the first flange and at least the portion of the second flange of the first non-metallic I-shaped beam and at least the portion of the first flange and at least the portion of the second flange of the second non-metallic I-shaped beam are exposed and substantially parallel to the outer surface of the foam thereof.

* * * * *